US008535010B2

(12) United States Patent
Terao

(10) Patent No.: US 8,535,010 B2
(45) Date of Patent: Sep. 17, 2013

(54) AXIAL FLOW FAN

(75) Inventor: Gen Terao, Kodaira (JP)

(73) Assignee: Balmuda Inc., Tokyo (JP)

( * ) Notice: Subject to any disclaimer, the term of this patent is extended or adjusted under 35 U.S.C. 154(b) by 29 days.

(21) Appl. No.: 13/288,526

(22) Filed: Nov. 3, 2011

(65) Prior Publication Data

US 2012/0107092 A1 May 3, 2012

Related U.S. Application Data

(63) Continuation of application No. PCT/JP2010/060746, filed on Jun. 24, 2010.

(30) Foreign Application Priority Data

Jun. 28, 2009 (JP) ..... 2009-169502

(51) Int. Cl.
*B64C 11/00* (2006.01)

(52) U.S. Cl.
USPC ..... 416/193 R

(58) Field of Classification Search
USPC ..... 415/77, 78, 79; 416/189, 193 R, 416/194, 196 R, 196 A, 175, 178
See application file for complete search history.

(56) References Cited

U.S. PATENT DOCUMENTS 5,755,557 A * 5/1998 Alizadeh ..... 416/193 R

FOREIGN PATENT DOCUMENTS

| | | | |
|---|---|---|---|
| JP | 58-156117 | U | 10/1983 |
| JP | 10-141285 | A | 5/1998 |
| JP | 10-205330 | A | 8/1998 |
| JP | 2000-120590 | A | 4/2000 |
| JP | 2002-221191 | A | 8/2002 |
| JP | 2003-120588 | A | 4/2003 |
| JP | 2004-060447 | A | 2/2004 |

OTHER PUBLICATIONS

International Search Report of PCT/JP2010/060746, mailing date Sep. 21, 2010.

* cited by examiner

*Primary Examiner* — Nathaniel Wiehe
*Assistant Examiner* — Adam W Brown
(74) *Attorney, Agent, or Firm* — Westerman, Hattori, Daniels & Adrian, LLP

(57) ABSTRACT

An axial flow fan including a rotation shaft section to be mounted on the rotation shaft of rotation drive means, an inner blade group provided outside the rotation shaft section so as to be coaxial therewith, and an outer blade group provided outside the inner blade group so as to be coaxial therewith, wherein the inner blade group is formed of a plurality of inner blades provided radially around the rotation shaft section, the outer blade group is formed of a plurality of outer blades provided radially around the rotation shaft section, and the velocity $V_1$ of the wind generated by the inner blade group and the velocity $V_2$ of the wind generated by the outer blade group have a relationship of $1.5V_1<V_2$ by designing the blades of the inner blade group and the outer blade group with respect to number, area, angle and shape.

5 Claims, 15 Drawing Sheets

PRIOR ART

AXIAL FLOW FAN

TECHNICAL FIELD

The present invention relates to the shape of the axial flow fan of an air blowing section in an appliance required to blow air, such as a fan, a ventilator or a heater.

BACKGROUND ART

FIGS. 3 and 4 are explanatory views showing an axial flow fan having conventional five blades. FIG. 3 is a front view showing a conventional five-bladed axial flow fan, and FIG. 4 is a perspective view showing the conventional five-bladed axial flow fan. FIG. 14 is a view showing the spread of the wind generated when the conventional five-bladed axial flow fan is rotated. FIG. 16 is an explanatory view showing an axial flow fan having blades, the number of which is made larger than that of the blades of the conventional axial flow fan, while the shape of the blades remains the same.

Conventionally, an axial flow fan having three to five blades, in particular, an axial flow fan having five blades shown in FIGS. 3 and 4, is frequently used for general fans or the like. Since such an axial flow fan is easy to mold when it is produced, the shape of the fan has been unchanged for many years.

Furthermore, as shown in FIG. 14, in the case that the conventional axial flow fan having five blades, 30 cm in diameter, was rotated at 800 rpm, the diameter of the wind 19 generated from the axial flow fan was 50 cm at a position 3 m away from the front of the axial flow fan; the spread of the wind was almost negligible.

However, for example, the wind generated by a fan is frequently required to be distributed in a wide range, as in the case that such a fan is generally equipped with an oscillating function. Moreover, a blower is also used for a heater to distribute heat widely to a living space. Even in this case, heat transfer to the space is attained more easily when the air blowing range of the blower is wider.

In these circumstances, in the case of an appliance that uses an axial flow fan to blow air, it is frequently found that the fan is used more conveniently when the area of the wind generated during use is wider. For example, in the case that a huge axial flow fan is rotated, wind having a large area can be obtained. However, it is not realistic to install such a huge axial flow fan in the air blowing section of an existing appliance having an air blowing function because of the limited space in the appliance. Hence, it is preferably desired that the spread of the generated wind, i.e., the area of the wind, is increased without changing the diameter of the axial flow fan.

Furthermore, the volume of the wind generated from the axial flow fan becomes larger as the area of the blades thereof is larger in the case that the rotation speed is the same.

This means that, in the case that an axial flow fan, the area of the blades of which is larger than that of the conventional axial flow fan having five blades, for example, is rotated, the rotation speed of the axial flow fan can be made lower than that of the conventional axial flow fan having five blades, for example, to obtain the same volume of wind. This may lead to improvement in noise and power consumption.

However, at present, most of axial flow fans for use in fans, ventilators, heaters, etc. do not have more than five blades, and axial flow fans, the areas of the blades of which are significantly large, are not available.

This is mainly attributed to the fact that knowledge about fluid dynamics, etc. are required to design an axial flow fan having excellent efficiency and the fluid dynamics itself has many unknown aspects, whereby difficulties in design are anticipated easily and problems that can arise during high-volume production are anticipated.

For example, in the case that for the purpose of increasing the area of the blades of an axial flow fan, a shape 21 is formed by increasing the number of the blades of a generally-used five-bladed axial flow fan 10 while the shape of the blades remains unchanged as shown in FIG. 16, an overlap 22 is generated between the adjacent blades at the root sections of the blades as viewed from the front of the axial flow fan. This means that an undercut portion is generated when a two-part injection molding die for high-volume production is used for plastic molding, for example. This is unrealistic when it is assumed that high-volume production is carried out.

Moreover, as a solution to this problem, an idea of making the root sections of the blades slender so that the adjacent blades do not overlap can be conceived easily. However, a larger load is applied to a portion closer to the outer circumference of each blade during rotation, and the load is supported only by the root section that is made slender to prevent overlap, whereby there occurs a problem in the strength of the root section. Hence, it is preferably desired that the number and the area of the blades of the axial flow fan are increased while the strength of the axial flow fan itself is maintained high by adopting a shape that can be produced by two-part injection molding serving as a general high-volume production method.

PRIOR ART DOCUMENT

Patent Document

Patent document 1: Japanese Patent Application Laid-Open Publication No. Hei 10-141285

Patent document 2: Japanese Patent Application Laid-Open Publication No. 2000-120590

Patent document 3: Japanese Patent Application Laid-Open Publication No. 2002-221191

Patent document 4: Japanese Patent Application Laid-Open Publication No. 2004-060447

SUMMARY OF THE INVENTION

Problem to be Solved by the Invention

One problem to be solved by the present invention is that although wind having a wider area is frequently demanded in axial flow fans for blowing air, conventional axial flow fans cannot generate such wind having a wider area. Another problem to be solved is that in the case that the area of the blades is increased to produce an axial flow fan featuring a large volume of wind, low rotation speed, low noise and energy saving, the efficiency during high-volume production is hardly compatible with the strength of the axial flow fan itself.

Means for Solving the Problem

An axial flow fan according to the present invention is equipped with a rotation shaft section to be mounted on the rotation shaft of rotation drive means, such as a motor, an inner blade group provided outside the rotation shaft section so as to be coaxial therewith, and an outer blade group provided outside the inner blade group so as to be coaxial therewith, and the axial flow fan is characterized in that the inner blade group is formed of a plurality of inner blades provided radially around the rotation shaft section and that the outer blade group is formed of a plurality of outer blades provided radially around the rotation shaft section.

More specifically, the axial flow fan according to the present invention is equipped with the rotation shaft section, an intermediate ring positioned between the rotation shaft section and the outer circumference of the fan and being concentric with the rotation shaft section, the inner blade group extending to the intermediate ring from the rotation shaft section serving as a root, and the outer blade group extending to the outer circumference of the fan from the intermediate ring serving as a root, wherein the inner blade group is different from the outer blade group in the number, area, shape and angle of the blades so that the inner blade group and the outer blade group do not relate to each other in shape, whereby the blades can be formed into shapes so as not to overlap with each other as viewed from the front of the fan and the intermediate ring contributes to the increase in the strength of the entire fan.

In addition, the axial flow fan according to the present invention is characterized in that since the inner blade group is different from the outer blade group in the number, area, shape and angle of the blades, when the axial flow fan is rotated as a fan, the velocity of the wind generated from the inner blade group can be made different from the velocity of the wind generated from the outer blade group.

More specifically, the axial flow fan according to the present invention is equipped with the rotation shaft section; the intermediate ring positioned between the rotation shaft section and the outer circumference of the fan and being concentric with the rotation shaft section; the inner blades extending radially around the rotation shaft section to the intermediate ring and connected to the intermediate ring while the roots of the inner blades are connected to the rotation shaft section; the inner blade group formed of the plurality of the inner blades duplicated and arranged sequentially in the rotation direction around the rotation shaft section; the outer blades expanding and extending to the outer circumference of the fan as viewed from the front in the radial direction around the rotation shaft section while the roots of the outer blades are connected to the intermediate ring; and the outer blade group formed of the plurality of the outer blades duplicated and arranged sequentially in the rotation direction around the rotation shaft section.

Furthermore, the inner blades of the inner blade group are connected to the rotation shaft section while having an attack angle in the rotation direction; the outer blades of the outer blade group are connected to the intermediate ring while having an attack angle in the rotation direction; the front fringe of the inner blade in the rotation direction and the front fringe of the outer blade in the rotation direction are not on a continuous line as viewed from the front of the fan; the rear fringe of the inner blade in the rotation direction and the rear fringe of the outer blade in the rotation direction are not on a continuous line as viewed from the front of the fan; and the inner blade group is independent of the outer blade group.

The number, area, angle and shape of the inner blades of the inner blade group and those of the outer blades of the outer blade group connected to the intermediate ring can be set independently.

When the attack angle of the inner blade is $\alpha_1$ and the attack angle of the outer blade is $\alpha_2$, it is preferable that the attack angle $\alpha_1$ and the attack angle $\alpha_2$ have a relationship of $\alpha_1<\alpha_2$. In the case that the attack angle of the inner blade is different depending on position, the attack angle $\alpha_1$ is used as an average value, and in the case that the attack angle of the outer blade is different depending on position, the attack angle $\alpha_2$ is used as an average value. Furthermore, when the total area of the inner blades is $S_1$ and the total area of the outer blades is $S_2$, it is preferable that the area $S_1$ and the area $S_2$ have a relationship of $S_1<S_2$. Moreover, it is preferable that the velocity $V_1$ of the wind generated by the inner blade group and the velocity $V_2$ of the wind generated by the outer blade group have a relationship of $1.5V_1<V_2$.

Additionally, it is preferable that the total area $S_g$ of the gaps among the adjacent inner blades of the inner blade group as viewed from the front of the fan and the total area $S_1$ of the inner blades have a relationship of $S_g<0.12S_1$. In the case that the gap between the inner blades is large as in the axial flow fan based on the conventional technology, air is sucked from the gap between the inner blades by the fast and strong wind generated by the outer blade group, and this air joins the wind generated by the inner blades, whereby the velocity of the obtained wind is increased. Hence, the difference between the velocity of the wind generated by the region of the inner blades and the velocity of the wind generated by the region of the outer blades does not become very large.

Still further, when a projection view from the point of view in which the rotation shaft section of the axial flow fan and the outer circumference of the fan can be seen concentric is a front view of the intermediate ring, the cross-section of the intermediate ring in the side view is not required to be formed into a plate shape but may be formed into other shapes, such as an elliptical shape and a wing shape.

Effect of the Invention

FIGS. 1 and 2 are views showing the axial flow fan according to the present invention. FIG. 1 is a front view showing the axial flow fan according to the present invention, and FIG. 2 is a perspective view showing the axial flow fan according to the present invention and an explanatory view of a motor, FIGS. 3 and 4 are explanatory views of the axial flow fan having the conventional five plates. FIG. 14 is a view showing the spread of the wind generated when the conventional five-bladed axial flow fan is rotated. FIG. 15 is an explanatory view showing the spread of the wind generated when the axial flow fan according to the present invention is rotated.

With the present invention, since the inner blades 2 of the inner blade group of the intermediate ring 1 is made different from the outer blades 3 of the outer blade group thereof in number, shape and angle, when the axial flow fan is rotated, the volume of the wind pushed out from the inside of the intermediate ring 1 can be made different from the volume of the wind pushed out from the outside of the intermediate ring 1. More specifically, in the case that the axial flow fan is rotated as a single axial flow fan 7, the velocity of the wind generated from the inside 11 of the intermediate ring 1 can be made different from the velocity of the wind generated from the outside 12 thereof, and a difference in density can be generated between the air pushed out from the inside 11 of the intermediate ring 1 and the air pushed out from the outside 12 thereof. Hence, the present invention is effective in that the wind generated from the inside 11 of the intermediate ring 1 and the wind generated from the outside 12 thereof are allowed to influence each other, and a movement 19 in which the wind usually spreads only mildly can be changed to a movement in which the wind flows in different directions.

In addition, with the present invention, since the inner blades 2 of the inner blade group of the intermediate ring 1 and the outer blades 3 of the outer blade group thereof are adjusted in number, angle and shape according to design intention, when the axial flow fan is rotated as the single axial flow fan 7, the difference between the velocity of the wind generated from the inner blade group of the intermediate ring and the velocity of the wind generated from the outer blade group thereof can be adjusted. Hence, the present invention is effective in that the change in the direction of the wind generated from the front of the axial flow fan due to the difference can be adjusted intentionally.

Furthermore, with the present invention, in the case that the number, area and shape of the blades of the inner and outer blade groups of the intermediate ring 1 are set according to design intention so that the velocity $V_2$ of the wind generated from the outside 12 of the intermediate ring 1 is significantly higher than the velocity $V_1$ of the wind generated from the inside 11 of the intermediate ring 1, due to the difference in the density of the fluid pushed out at a position very close to the front of the rotating axial flow fan, the wind generated from the outside of the intermediate ring 1 is pulled by the wind generated from the inside of the intermediate ring 1 and being low in density. Usually, the movement 19 in which the wind spreads mildly can be changed to a movement 30 in which the wind is drawn inward. The wind is thus collected at a position 31 located a short distance of several ten cm from the front of the rotating axial flow fan. Then, due to the kinetic energy of the swirling air generated from the rotating axial flow fan and the counteraction of the collection of the wind at the one position, the movement is changed to a movement 20 in which the wind spreads extensively. Hence, the present invention is effective in that wind having an area larger than the spread of the wind from the conventional axial flow fan can be generated at a point away from the front of the rotating axial flow fan, approximately 3 m for example.

More specifically, with the present invention, the number, area and shape of the blades of the inner and outer blade groups of the intermediate ring 1 are set according to design intention. Hence, the present invention is effective in that the area of the wind generated at the position away from the front of the rotating axial flow fan, approximately 3 m for example, can be made five times or more as wide as the area of the wind generated when a conventional three- or five-bladed axial flow fan 10 is rotated at the same rotation speed.

Besides, with the present invention, the front fringe 32 of the inner blade 2 in the rotation direction 36 and the front fringe 33 of the outer blade 3 in the rotation direction 36 do not form a continuous line as viewed from the front, the rear fringe 34 of the inner blade 2 in the rotation direction 36 and the rear fringe 35 of the outer blade 3 in the rotation direction 36 do not form a continuous line as viewed from the front, and the blades 2 of the inner blade group and the blades 3 of the outer blade group can be formed into shapes independent from each other. For example, even in the case that the total area of the outer blades is made larger by increasing the number of the blades 3 of the outer blade group of the intermediate ring 1, the number of the inner blades 2 of the inner blade group of the intermediate ring 1 connected to the rotation shaft section can be decreased. Hence, the present invention is effective in that the total area of the blades of the entire axial flow fan can be made larger while eliminating overlap between the blades in the vicinity of the rotation shaft section and facilitating injection molding at the time of high-volume production.

What's more, with the present invention, the intermediate ring 1 itself increases the physical strength of the entire axial flow fan. Hence, the present invention is effective in that even in the case that the total area of the blades of the axial flow fan is made larger, sufficient strength can be provided in the case that a general high-volume production method, such as plastic injection molding, is used.

Additionally, with the present invention, the inner blade group and the outer blade group of the intermediate ring 1 are not required to be formed continuously in the radial direction but can be made independent from each other. At the time of high-volume production, an axial flow fan in which the total number of the blades and the total area of the blades are increased can be produced without consideration of the overlap between the blades, i.e., a problem during high-volume production. Hence, the present invention is effective in that in the case that this axial flow fan is rotated, the axial flow fan can produce the volume of wind larger than that obtained when the conventional three- or five-bladed axial flow fan is rotated at the same rotation speed.

Still further, with the present invention, the number of the blades of the inner blade group of the intermediate ring 1 and the number of the blades of the outer blade group thereof can be set without consideration of the overlap of the blades at the root sections thereof and the problem of insufficient strength after production, and the number of the blades can be increased significantly. It is said that the wind from a five-bladed axial flow fan is felt more gently and favorably than that from a three-bladed axial flow fan, for example. Hence, the present invention is effective in that the axial flow fan according to the present invention can generate wind that can be felt still more gently and favorably by using more than five blades.

MODES FOR CARRYING OUT THE INVENTION

An object of the present invention is to provide an air blowing axial flow fan for generating wind having a wider area, a larger volume and being gentle and favorable without changing the outside diameter and the rotation speed of the axial flow fan. This object is accomplished by adopting a configuration in which an intermediate ring being concentric with the rotation shaft section of the axial flow fan is provided between the rotation shaft section and the outer circumference of the fan, and the blades of the inner and outer blade groups of the intermediate ring are designed so as to have any given shape, number and area while high-volume production is made possible and the problem in the strength of the axial flow fan itself is solved.

Embodiment 1

Figure 1:
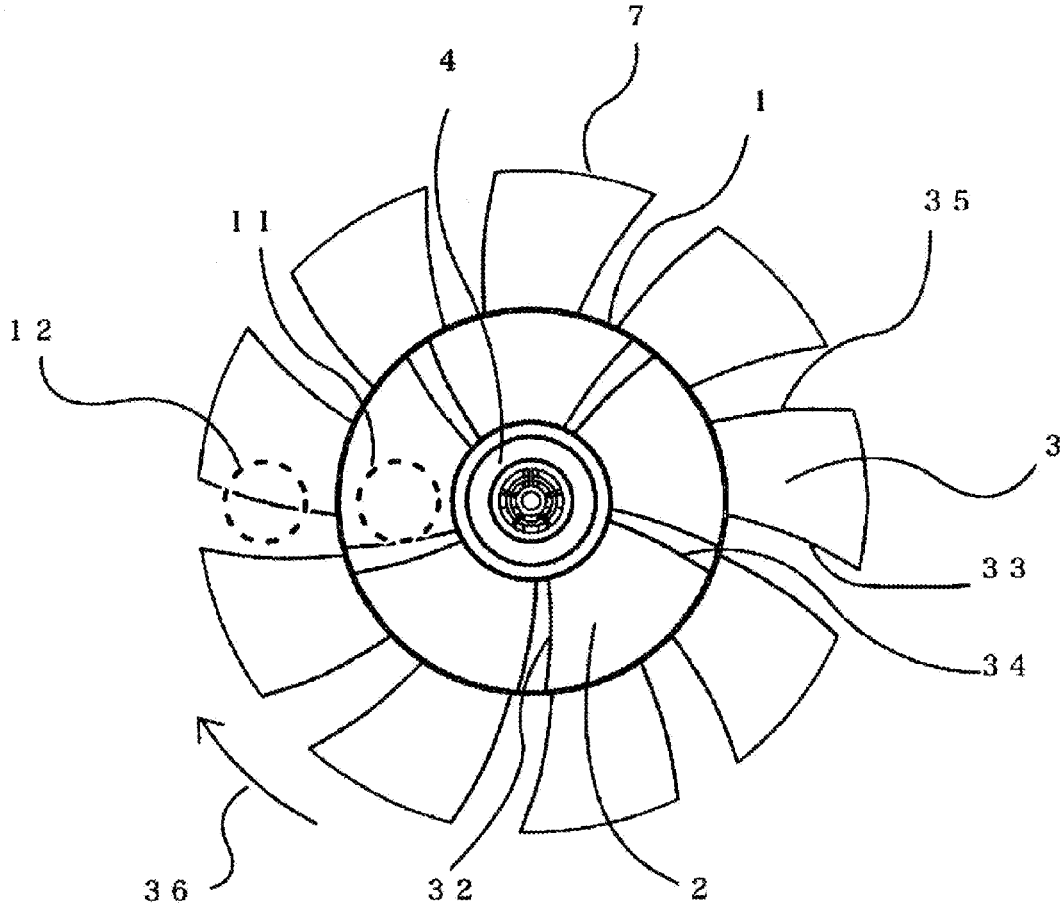
FIG. 1 is a front view showing an axial flow fan according to the present invention.
Figure 2:
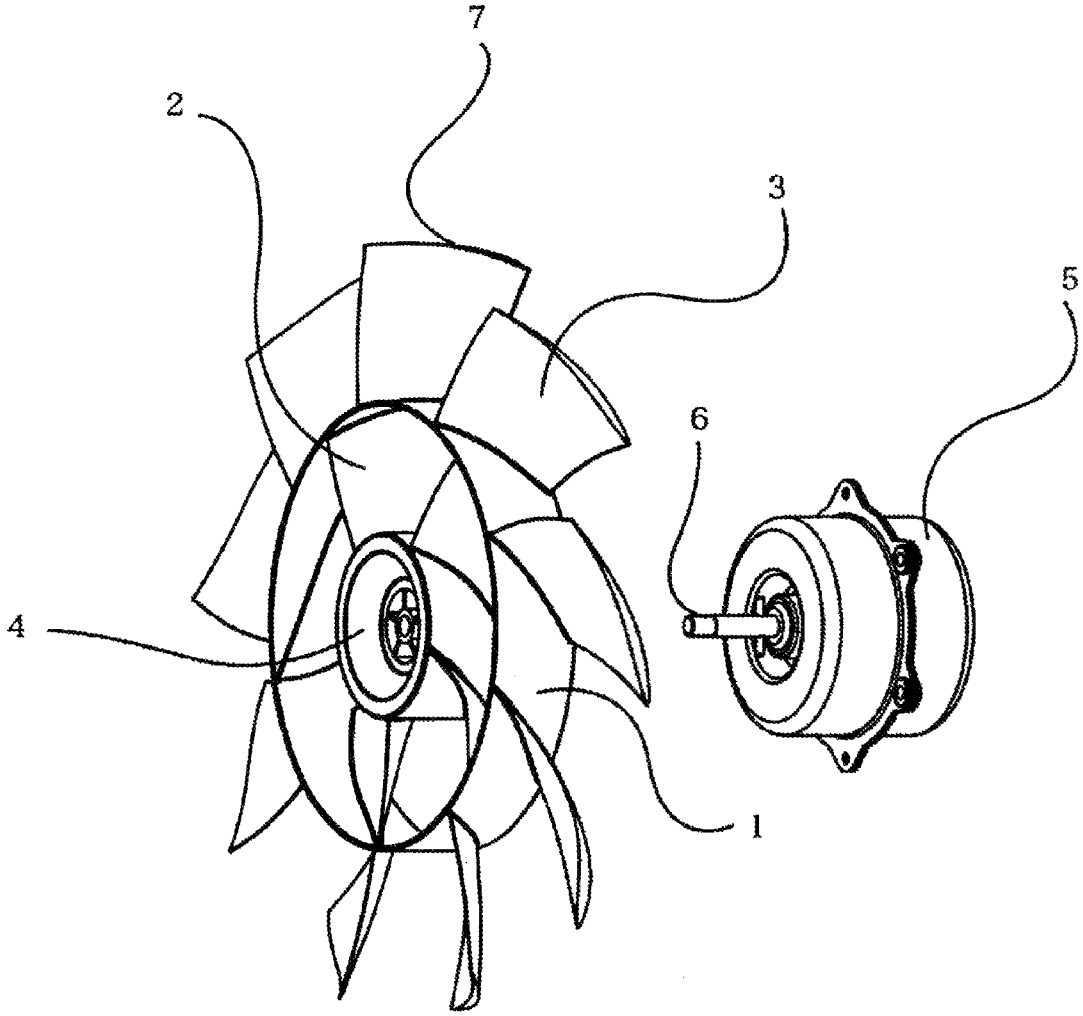
FIG. 2 is a perspective view showing the axial flow fan according to the present invention and a motor.
Figure 3:
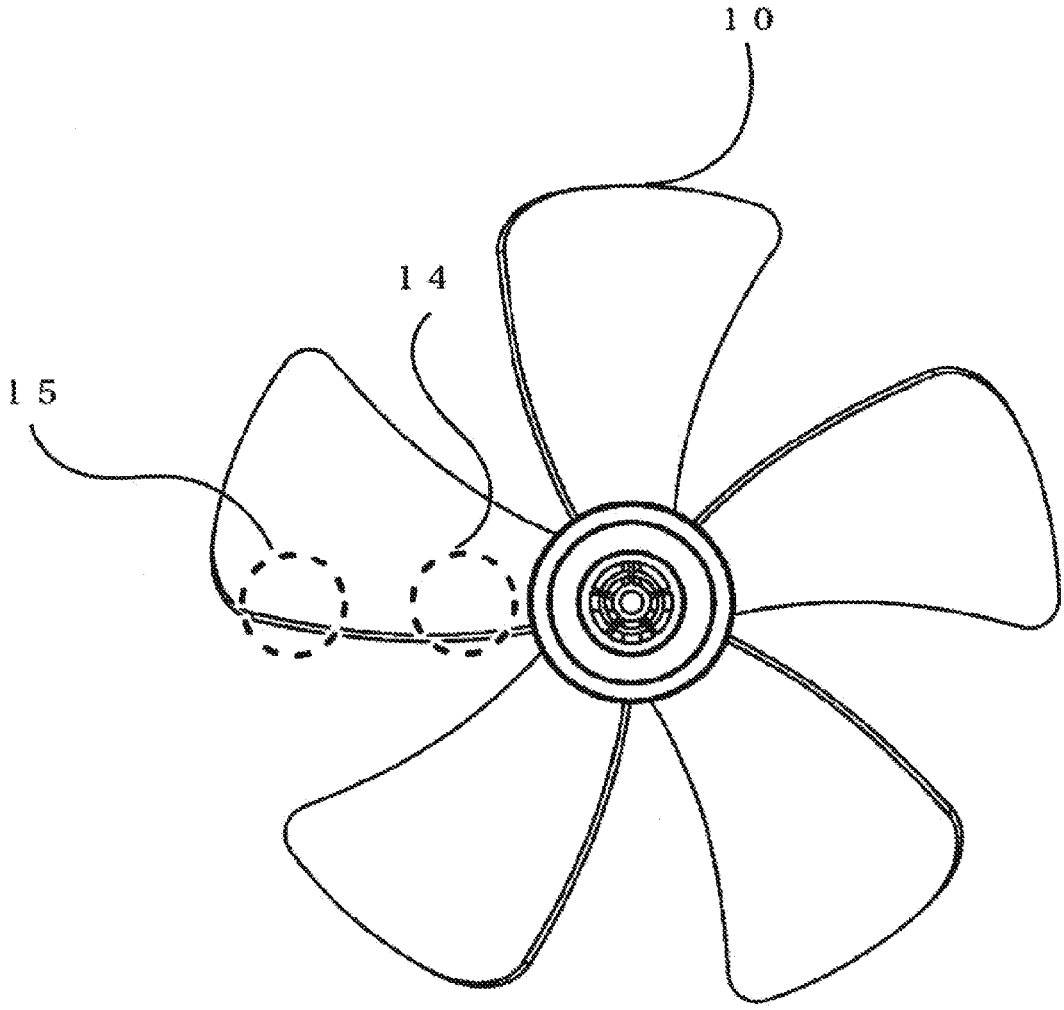
FIG. 3 is a front view showing a conventional five-bladed axial flow fan.
Figure 4:
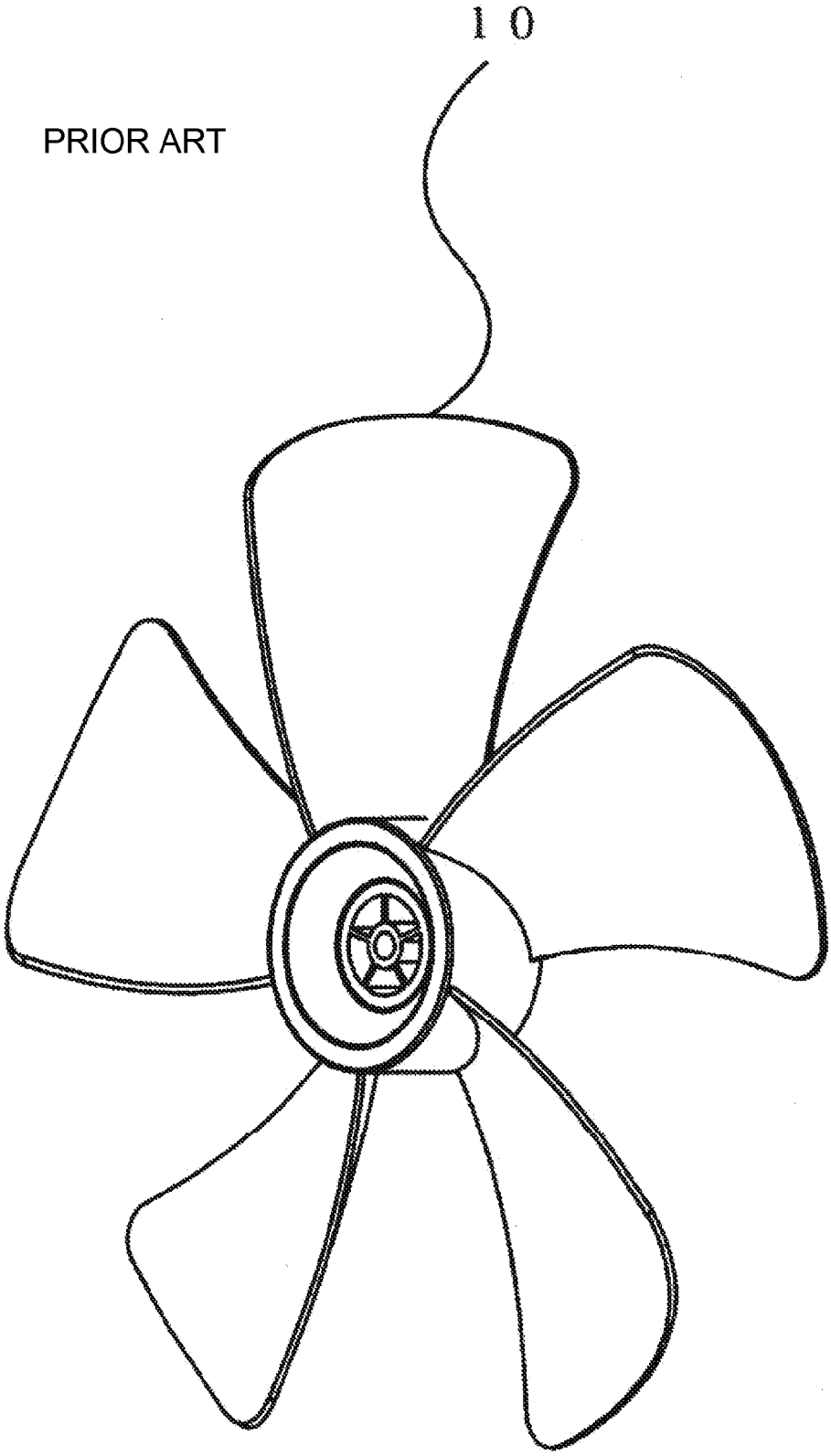
FIG. 4 is a perspective view showing the conventional five-bladed axial flow fan.
Figure 5:
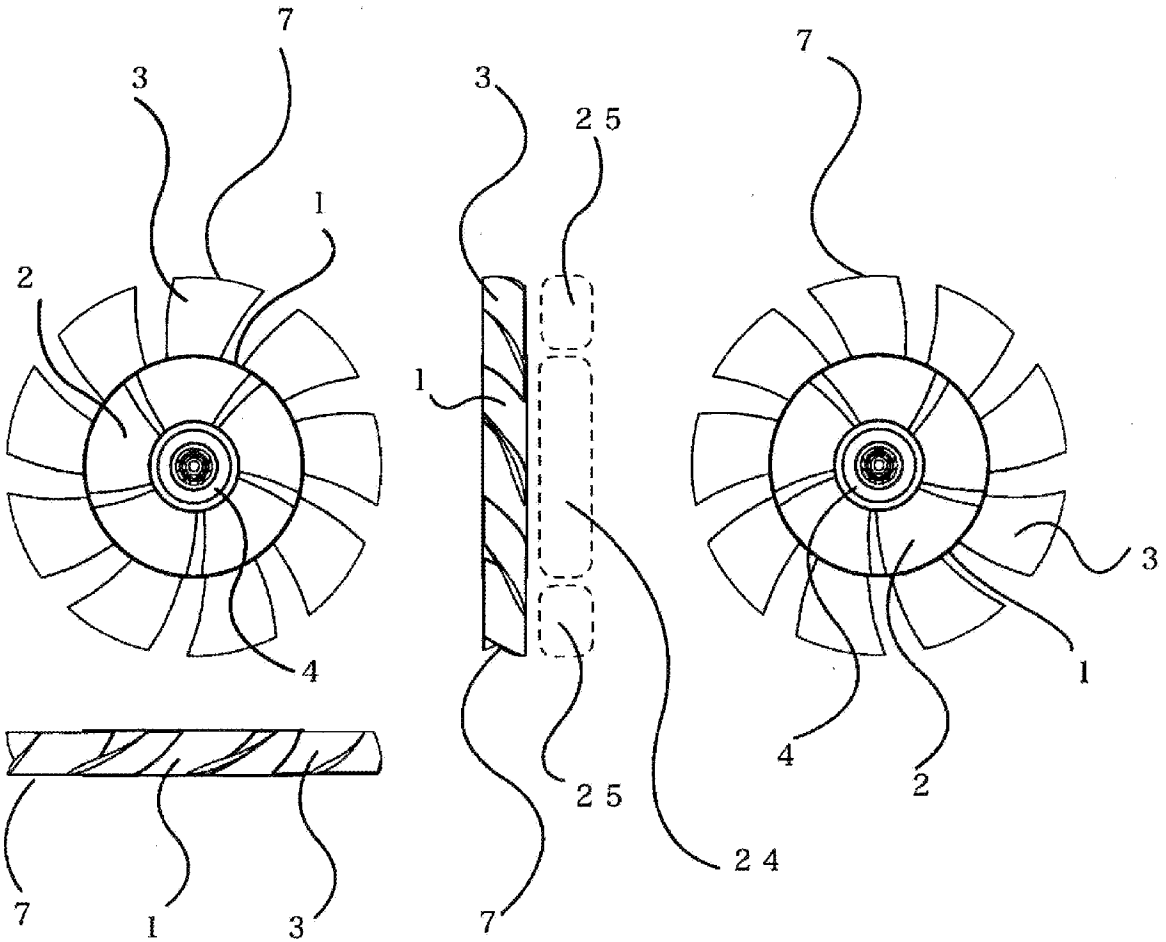
FIG. 5 is a trihedral view showing the axial flow fan according to the present invention.
Figure 6:
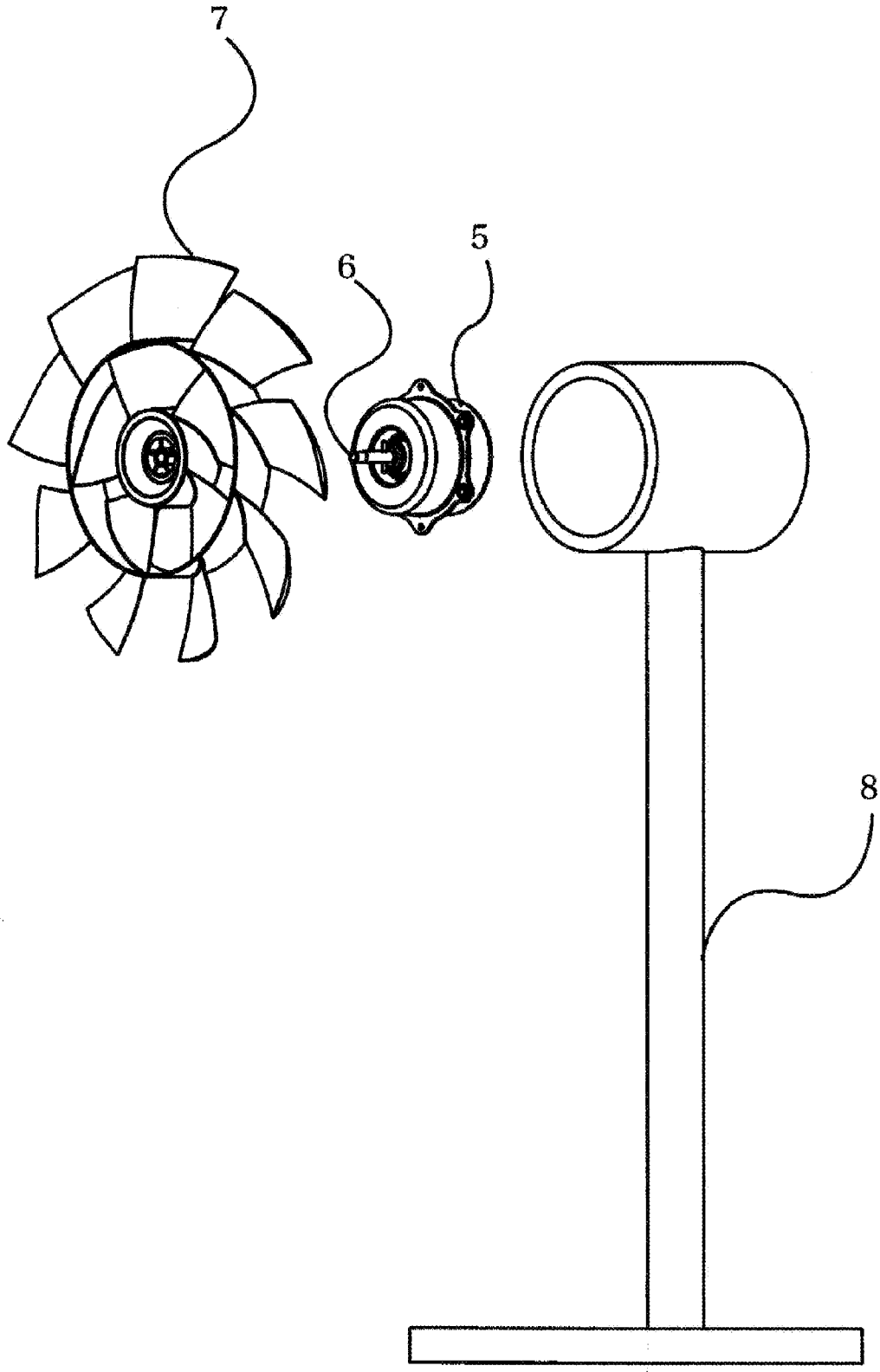
FIG. 6 is an explanatory view showing the axial flow fan, the motor on which the axial flow fan is mounted, and a fan-type motor supporting apparatus for supporting the motor.
Figure 7:
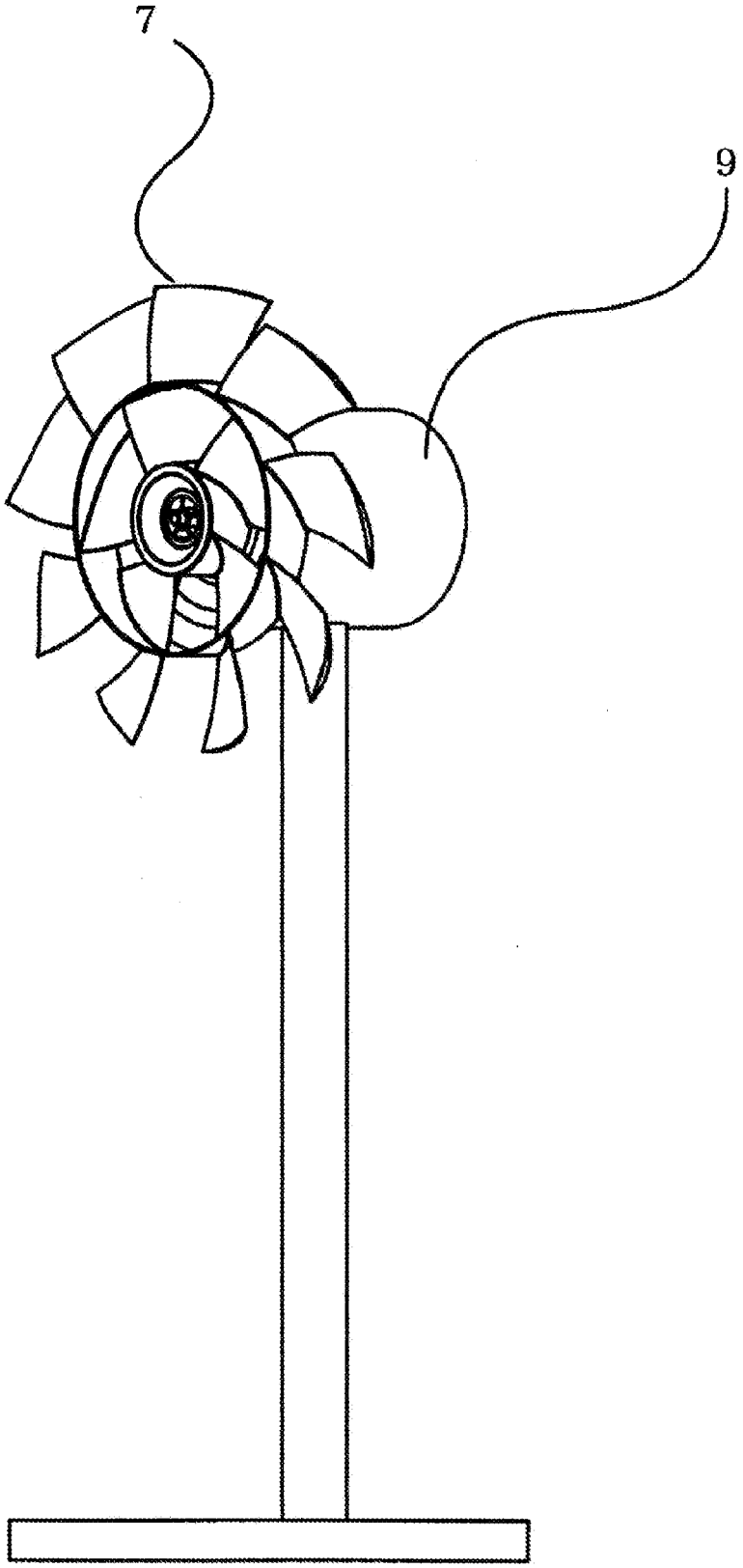
FIG. 7 is an explanatory view showing the axial flow fan according to the present invention mounted in the fan-type motor supporting apparatus.
Figure 8:
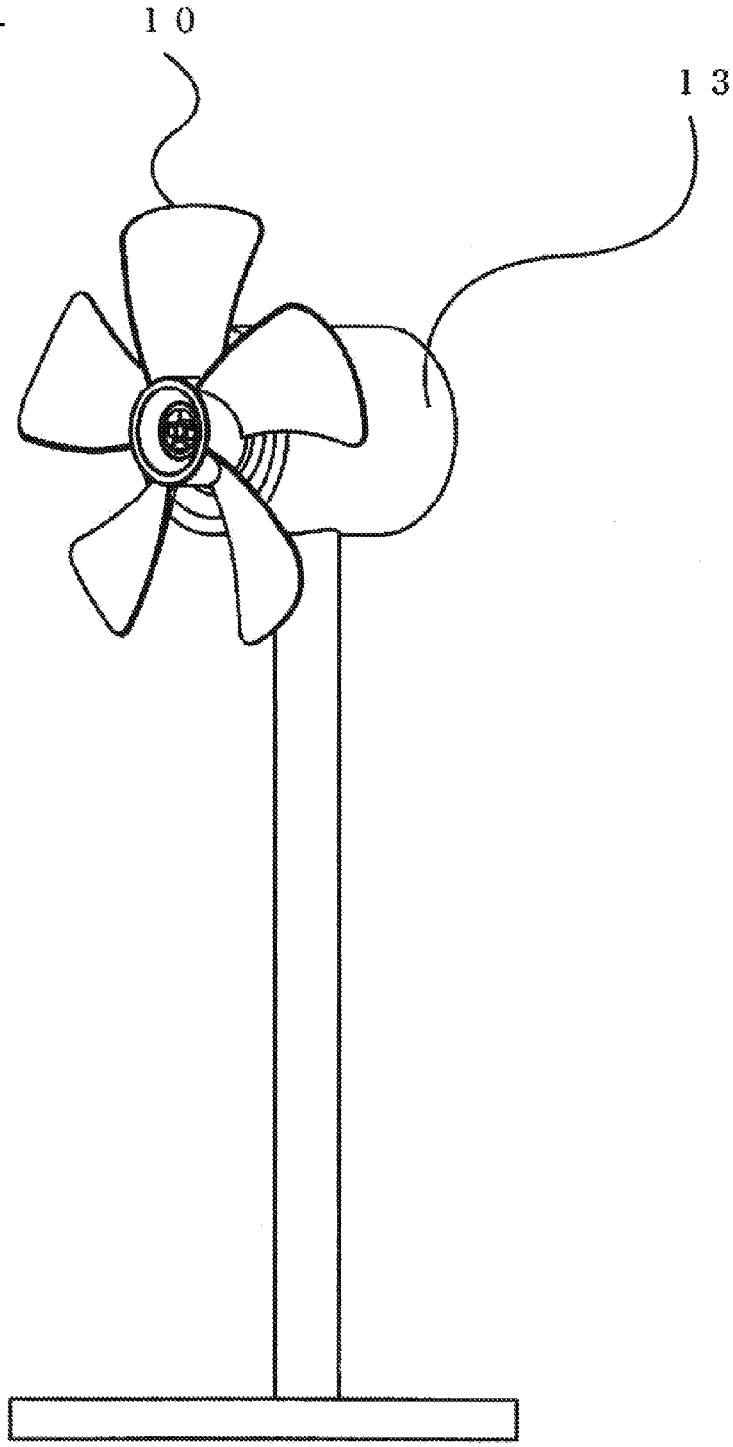
FIG.8 PRIOR ART
FIG. 8 is an explanatory view showing a general axial flow fan having conventional five blades in the fan-type motor supporting apparatus.
Figure 9:
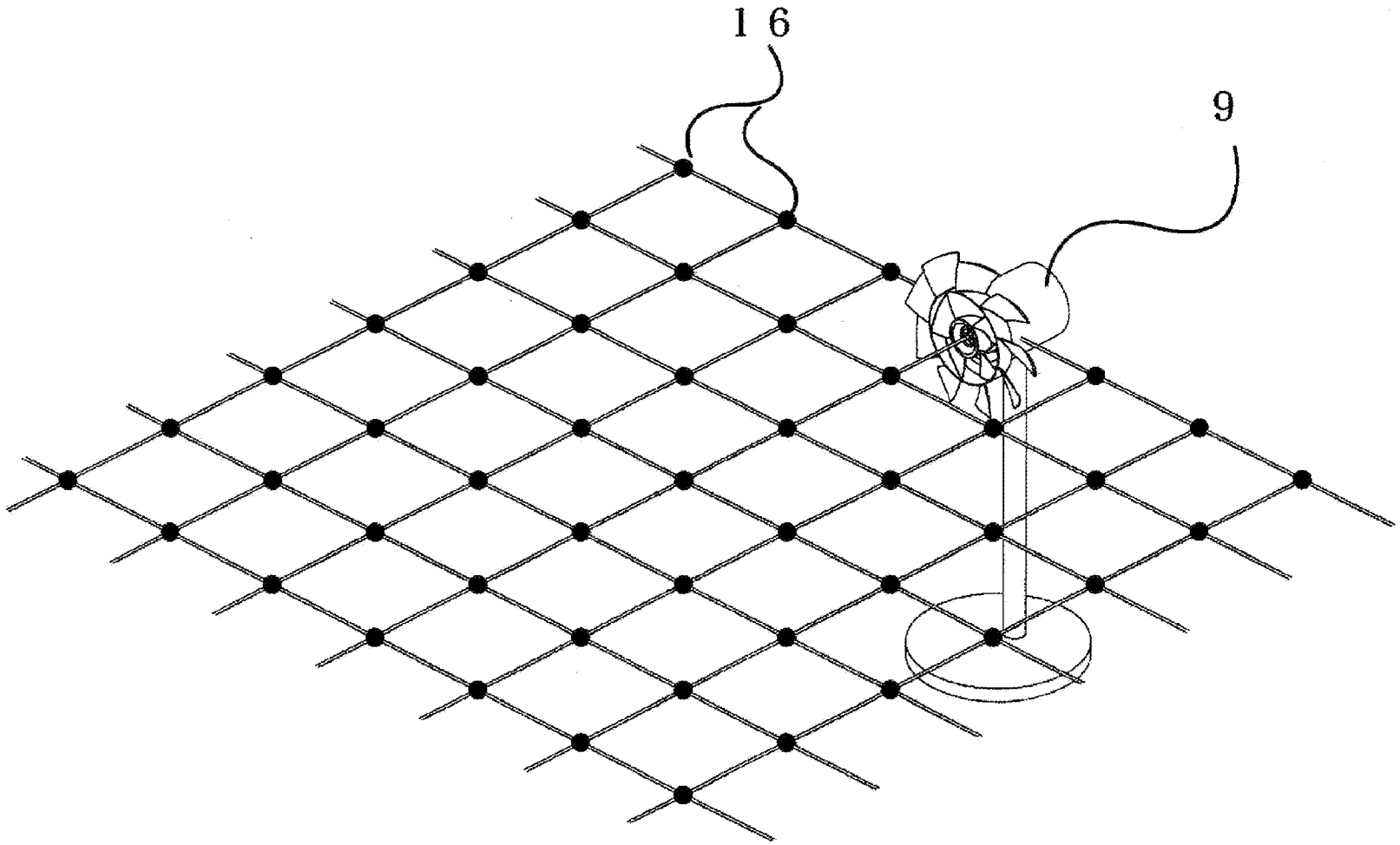
FIG. 9 is a perspective view showing measurement points that are used when the air blowing range of the axial flow fan is measured.
Figure 10:
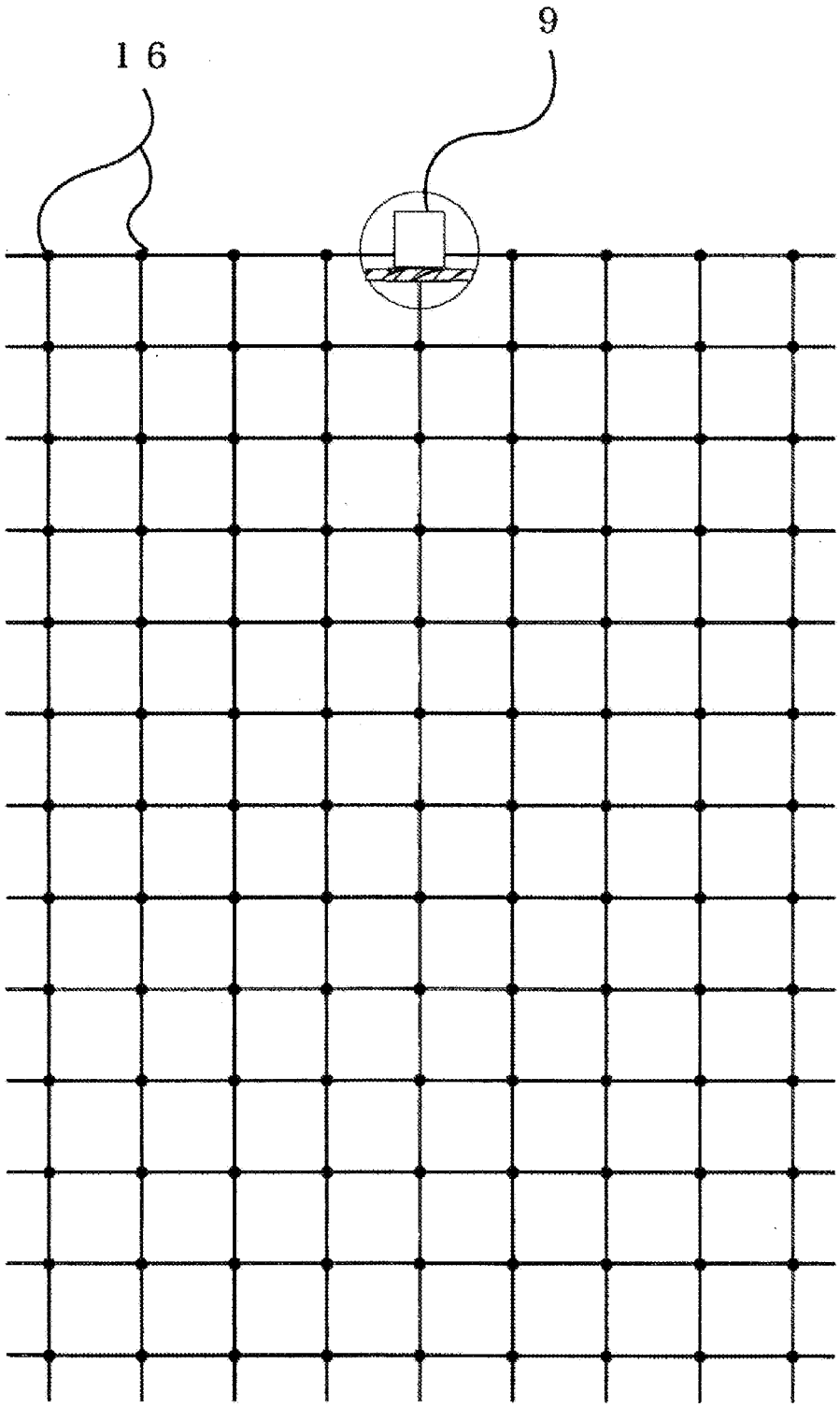
FIG. 10 is a view showing the measurement points that are used when the air blowing range of the axial flow fan is measured.
Figure 14:
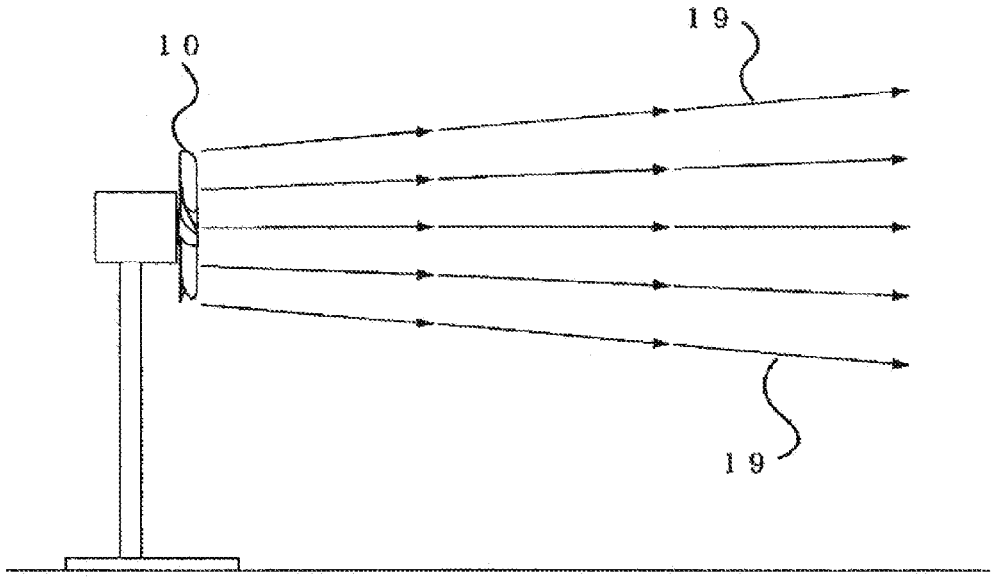
FIG.14 PRIOR ART
FIG. 14 is an explanatory view showing the spread of the wind generated when the conventional five-bladed axial flow fan is rotated.
Figure 15:
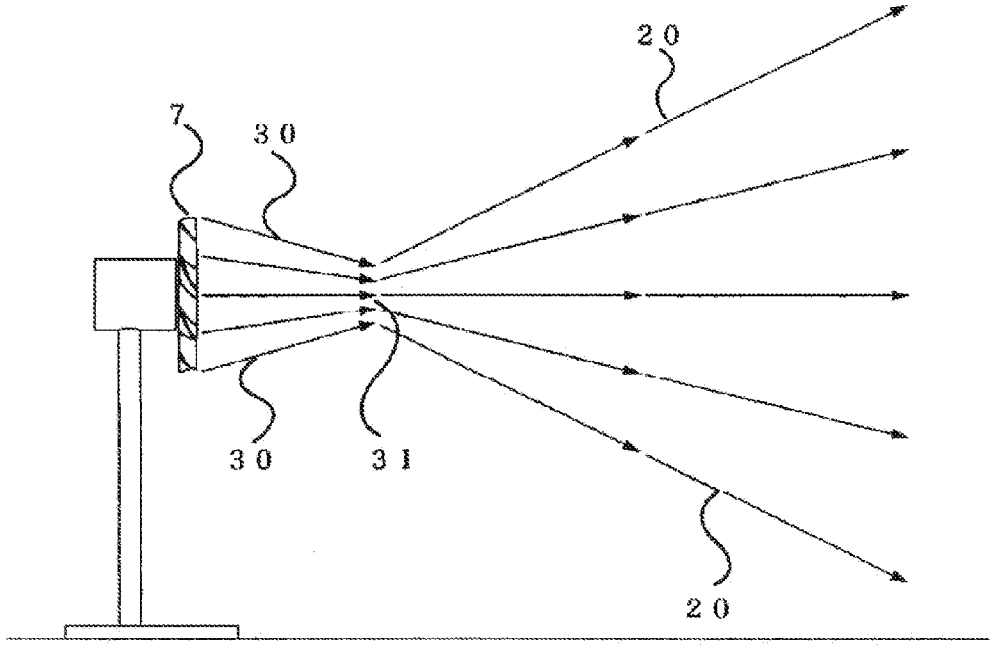
FIG. 15 is a view showing the spread of the wind generated when the axial flow fan according to the present invention is rotated.
Figure 16:
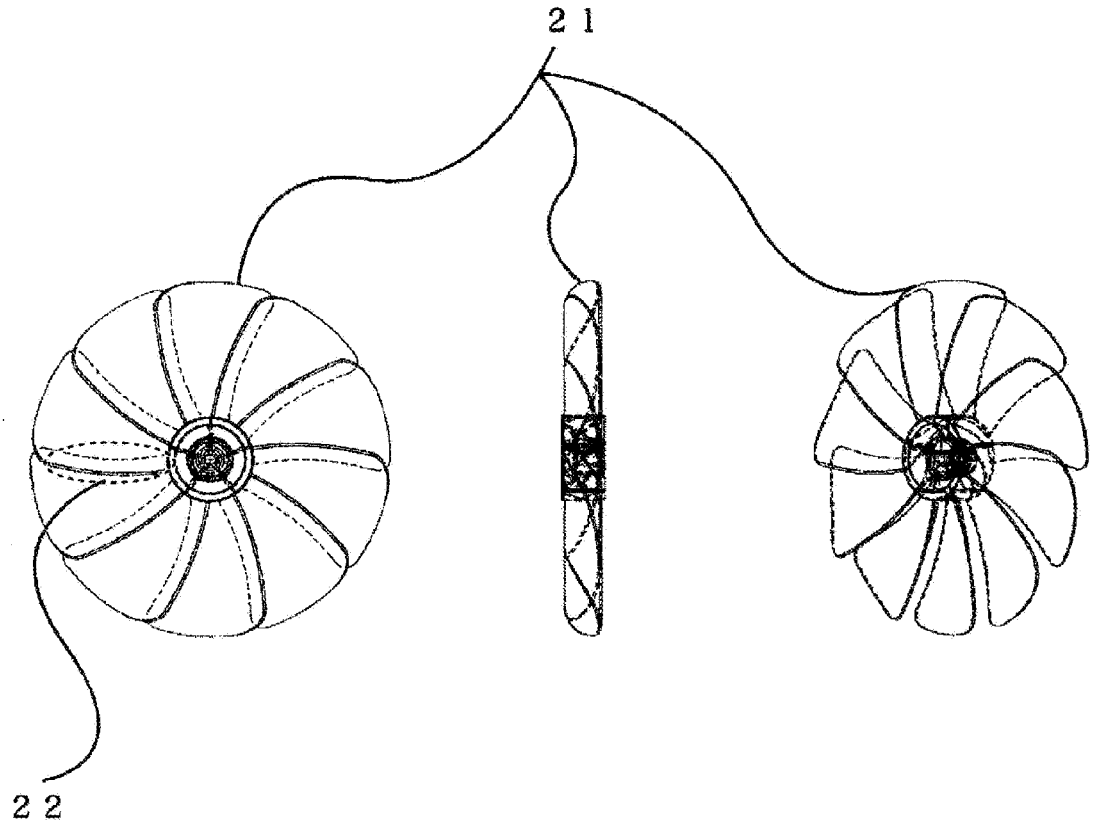
FIG. 16 is an explanatory view showing the axial flow fan having blades, the number of which is made larger than that of the blades of the conventional axial flow fan while the shape of the blades remains the same.

FIG. 1 is a front view showing an axial flow fan according to the present invention, FIG. 2 is a perspective view showing the axial flow fan according to the present invention and a motor, FIG. 3 is a front view showing a conventional five-bladed axial flow fan, FIG. 4 is a perspective view showing the conventional five-bladed axial flow fan, FIG. 5 is a trihedral view showing the axial flow fan according to the present invention, FIG. 6 is an explanatory view showing the motor on which the axial flow fan is mounted and a fan-type motor supporting apparatus for supporting the motor, FIG. 7 is an explanatory view showing the axial flow fan according to the present invention mounted in the fan-type motor supporting apparatus, FIG. 8 is an explanatory view showing a general axial flow fan having a conventional five blades in the fan-type motor supporting apparatus, FIGS. 9 and 10 are explanatory views showing measurement points that are used when the air blowing range of the axial flow fan is measured. FIG. 14 is an explanatory view showing the spread of the wind generated when the conventional five-bladed axial flow fan is rotated. FIG. 15 is an explanatory view showing the spread of the wind generated when the axial flow fan according to the present invention is rotated.

In these figures, numeral 1 designates an intermediate ring positioned between the rotation shaft section and the outer circumference of the axial flow fan and concentric with the rotation shaft section. In this case, the diameter of the intermediate ring 1 is 17 cm. Numeral 2 designates an inner blade of the intermediate ring 1, and the number of the inner blades included in the inner blade group of the intermediate ring 1 and arranged sequentially is five. Numeral 3 designates an outer blade of the intermediate ring 1, and the number of the outer blades included in the outer blade group of the intermediate ring 1 and arranged sequentially is nine. Furthermore, the rotation shaft section 4 of the axial flow fan is provided so as to be connected to the rotation shaft 6 of a motor 5 with a screw or the like.

The intermediate ring 1, the inner blade group formed of the inner blades 2 arranged sequentially, the outer blade group formed of the outer blades 3 arranged sequentially and the rotation shaft section 4 are connected to form a single plastic molded component. This molded component rotates as a single axial flow fan 7 having a diameter of 30 cm.

Furthermore, in order that the volume of the wind generated by the rotation of the axial flow fan 7 is increased, each of the blades 2 of the inner blade group and the blades 3 of the outer blade group of the intermediate ring 1 is configured so as to have a large area. Moreover, the shape and angle of each of the blades of the inner and outer blade groups of the intermediate ring 1 are set so that the difference between the velocity of the wind generated from the inner blade group and the velocity of the wind generated from the outer blade group becomes large when the axial flow fan 7 is rotated, that is to say, so that the velocity $V_2$ of the wind generated from the outer blade group formed of the outer blades 3 is larger than the velocity $V_1$ of the wind generated from the inner blade group formed of the inner blades 2.

The axial flow fan 7 was mounted on the rotation shaft 6 of the motor 5, and the motor 5 equipped with the axial flow fan 7 was mounted in a supporting apparatus 8 by securing the motor 5 thereto with a screw or the like, whereby a fan-type blower 9 was prepared.

The axial flow fan 7 of the blower 9 was then rotated at 800 rpm. The velocity of the generated wind was measured at a distance 1 cm away from the front of the axial flow fan 7 and at a position where the wind was generated from the inner blade group formed of the inner blades 2 arranged sequentially, that is, at a position 11 away from the rotation shaft section by 4 cm in the outer circumferential direction of the fan. Furthermore, the velocity of the wind was also measured at a position where the wind is generated from the outer blade group formed of the outer blades 3 arranged sequentially, that is, at a position 12 away from the rotation shaft section by 10 cm in the outer circumferential direction of the fan. The results of the measurement are shown in Table 1. The value of the wind velocity is the average value of the wind velocity values measured continuously for one minute at each position.

TABLE 1

| Axial flow fan 7 according to the present invention | |
|---|---|
| At position 11 away from rotation shaft section by 4 cm in outer circumferential direction | At position 12 away from rotation shaft section by 10 cm in outer circumferential direction |
| 3.58 m/s | 6.23 m/s |

Next, the general axial flow fan 10 having a diameter of 30 cm and formed of the conventional five blades was prepared, and the axial flow fan 10 was mounted on the rotation shaft 6 of the motor 5, and the motor equipped with the axial flow fan was mounted in the supporting apparatus 8 by securing the motor 5 thereto with a screw or the like, whereby a fan-type blower 13 was prepared.

The axial flow fan 10 of the blower 13 was then rotated at 800 rpm. In order that the measurement results correspond to those shown in Table 1, the velocity of the generated wind was measured at a distance 1 cm away from the front of the axial flow fan 10 and at a position 14 away from the rotation shaft section by 4 cm in the outer circumferential direction of the fan. Furthermore, the velocity of the wind was also measured at a position 15 away from the rotation shaft section by 10 cm in the outer circumferential direction of the fan. The results of the measurement are shown in Table 2. The value of the wind velocity is the average value of the wind velocity values measured continuously for one minute at each position.

TABLE 2

| Axial flow fan 10 formed of conventional five blades | |
|---|---|
| At position 14 away from rotation shaft section by 4 cm in outer circumferential direction | At position 15 away from rotation shaft section by 10 cm in outer circumferential direction |
| 3.30 m/s | 4.29 m/s |

When a comparison is made between Table 1 and Table, the wind velocity at the position away from the rotation shaft section by 10 cm in the outer circumferential direction of the fan is 1.74 times the wind velocity at the position away from the rotation shaft section by 4 cm in the outer circumferential direction of the fan in the case of Table 1. In the case of Table 2, the difference in the wind velocity is 1.3 times. It is thus found that in the case of the axial flow fan 7 according to the present invention in Table 1, the difference between the velocity of the wind generated in the vicinity of the outer circumference of the axial flow fan during the rotation and the velocity of the wind generated in the vicinity of the rotation shaft section is larger than the difference therebetween in the case of the axial flow fan 10 formed of the conventional five blades in Table 2.

At this time, in the case of the axial flow fan 10 formed of the conventional five blades in Table 2, the difference between the velocity of the wind generated in the vicinity of the outer circumference of the fan and the velocity of the wind generated in the vicinity of the rotation shaft section of the fan is small, and the axial flow fan 10 generates wind spreading mildly in a direction 19 as shown in FIG. 14.

Furthermore, in the case of the axial flow fan 7 according to the present invention in Table 1, the difference between the velocity of the wind generated in the vicinity of the outer circumference of the fan and the velocity of the wind generated in the vicinity of the rotation shaft section of the fan is large. Hence, when the axial flow fan is rotated, a large difference occurs between the amount of the air pushed out in a space 24 shown in FIG. 5 at a position very close to the front of the fan and in the vicinity of the rotation shaft section and the amount of the air pushed out in a space 25 shown in FIG. 5 in the vicinity of the outer circumference of the fan; in other words, a difference occurs in the density of the air. Due to the difference in the density of the air pushed out, the wind generated from the outside of the intermediate ring 1 is pulled by the wind generated from the inside of the intermediate ring 1 and being low in density. Usually, the movement 19 in which the wind spreads mildly is changed to the movement 30 in which the wind is drawn inward. The wind is thus collected at the position 31 located a short distance of approximately 40 cm from the front of the axial flow fan 7. Then, due to the counteraction of the collection of the wind at the one position, the movement is changed to the movement 20 in which the wind spreads extensively. The measurement results of the spread of the wind will be described below.

The rotation shaft section of the axial flow fan 7 of the blower 9 was then positioned horizontally, the height of the rotation shaft section was set at 60 cm from the ground, and the rotation shaft section was rotated at 800 rpm. For the purpose of checking the spread of wind, a net-like measurement space shown in FIGS. 9 and 10 was set on a horizontal plane orthogonal to the rotation shaft section of the axial flow fan 7 in the front direction of the axial flow fan 7, and a plurality of measurement points, i.e., black points 16, were set, and the velocity of the wind was measured at each of the points 16. The results of the measurement are shown in Table 3. The value of the wind velocity is the average value of the wind velocity values measured continuously for two minute at each position.

TABLE 3

Unit: m/s

| | 75 cm leftward | 50 cm leftward | 25 cm leftward | Front | 25 cm rightward | 50 cm rightward | 75 cm rightward | |
|---|---|---|---|---|---|---|---|---|
| 0 | — | — | — | — | — | — | — | 0 |
| 25 cm | 0 | 0 | | 2.77 | 0 | 0 | 0 | 0 |
| 50 cm | 0 | 0 | 0.2 | 2.8 | 0.21 | 0 | 0 | 25 cm |
| 75 cm | 0 | 0 | 0.88 | 2.83 | 0.85 | 0 | 0 | 50 cm |
| 100 cm | 0 | 0 | 1.42 | 2.57 | 1.36 | 0 | 0 | 75 cm |
| 125 cm | 0 | 0 | 1.18 | 2.3 | 1.2 | 0 | 0 | 100 cm |
| 150 cm | 0 | 0 | 1.04 | 2.07 | 1.08 | 0 | 0 | 125 cm |
| 175 cm | 0 | 0 | 1.04 | 1.88 | 1.06 | 0 | 0 | 150 cm |
| 200 cm | 0 | 0 | 1.14 | 1.68 | 1.1 | 0 | 0 | 175 cm |
| 225 cm | 0 | 0.11 | 0.85 | 1.49 | 0.9 | 0.1 | 0 | 200 cm |
| 250 cm | 0 | 0.14 | 0.94 | 1.44 | 0.92 | 0.17 | 0 | 225 cm |
| 275 cm | 0 | 0.18 | 0.69 | 1.27 | 0.72 | 0.16 | 0 | 250 cm |
| 300 cm | 0.06 | 0.16 | 0.61 | 1.17 | 0.63 | 0.15 | 0.05 | 275 cm |

Next, the rotation shaft section of the axial flow fan 10 of the blower 13 was positioned horizontally, the height of the rotation shaft section was set at 60 cm from the ground, and the rotation shaft section was rotated at 800 rpm. In order that the measurement results correspond to those shown in Table 3 described above, the velocity of the wind was measured at each point under measurement conditions similar to those of the measurement shown in Table 3. The results of the measurement are shown in Table 4. The value of the wind velocity is the average value of the wind velocity values measured continuously for two minute at each position.

TABLE 4

Unit: m/s

| | 75 cm leftward | 50 cm leftward | 25 cm leftward | Front | 25 cm rightward | 50 cm rightward | 75 cm rightward | |
|---|---|---|---|---|---|---|---|---|
| 0 | — | — | — | — | — | — | — | 0 |
| 25 cm | 0 | 0 | 0 | 3.22 | 0 | 0 | 0 | 0 |
| 50 cm | 0 | 0 | 0 | 3.28 | 0 | 0 | 0 | 25 cm |
| 75 cm | 0 | 0 | 0.01 | 3 | 0.02 | 0 | 0 | 50 cm |
| 100 cm | 0 | 0 | 0.3 | 2.69 | 0.35 | 0 | 0 | 75 cm |
| 125 cm | 0 | 0 | 0.55 | 2.28 | 0.52 | 0 | 0 | 100 cm |
| 150 cm | 0 | 0 | 0.52 | 2.08 | 0.48 | 0 | 0 | 125 cm |
| 175 cm | 0 | 0 | 0.47 | 1.86 | 0.42 | 0 | 0 | 150 cm |
| 200 cm | 0 | 0 | 0.45 | 1.62 | 0.48 | 0 | 0 | 175 cm |
| 225 cm | 0 | 0 | 0.65 | 1.5 | 0.61 | 0 | 0 | 200 cm |
| 250 cm | 0 | 0 | 0.5 | 1.36 | 0.46 | 0 | 0 | 225 cm |
| 275 cm | 0 | 0 | 0.44 | 1.21 | 0.43 | 0 | 0 | 250 cm |
| 300 cm | 0 | 0 | 0.44 | 1.01 | 0.4 | 0 | 0 | 275 cm |

When a comparison is made between Table 3 indicating the range of the wind of the axial flow fan 7 according to the present invention and Table 4 indicating the range of the wind of the axial flow fan 10 formed of the conventional five blades, it is found that the air blowing range of the axial flow fan 7 according to the present invention in Table 3 is larger than that of the axial flow fan 10 even though the two axial flow fans are the same in diameter and rotation speed; in other words, it is found that the area of the wind generated by the axial flow fan 7 can be made larger. Furthermore, the wind generated when an axial flow fan is rotated has an approximately circular shape as viewed from the front. Hence, the wind generated by the axial flow fan 7 according to the present invention has a diameter of approximately 1.5 m at a position 3 m away from the fan, and the wind generated by the axial flow fan 10 formed of the conventional five blades has a diameter of approximately 50 cm at the same position. Hence, at the position 3 m away from the front of the fan, it is found that the axial flow fan 7 according to the present invention generates wind, the area of which is approximately nine times the area of the wind generated by the axial flow fan 10 formed of the conventional five blades.

It is assumed that the above-mentioned results are caused by the ratio of the wind velocity values between the inner blade group and the outer blade group of the axial flow fan as described above. According to the results of Table 1, the velocity $V_1$ of the wind generated by the inner blade group and the velocity $V_2$ of the wind generated by the outer blade group according to the present invention have a relationship of $V_1:V_2=1:1.74$ as the ratio therebetween. According to the results of Table 2, the velocity $V_1$ of the wind generated by the inner portion and the velocity $V_2$ of the wind generated by the outer portion of the conventional axial flow fan have a relationship of $V_1:V_2=1:1.3$. On the basis of comprehensive judgments according to these results and other experimental results, it is assumed that the velocity $V_2$ of the wind formed by the inner blade group and the velocity $V_2$ of the wind formed by the outer blade group preferably have a relationship of $1.5V_1<V_2$.

Embodiment 2

Figure 11:
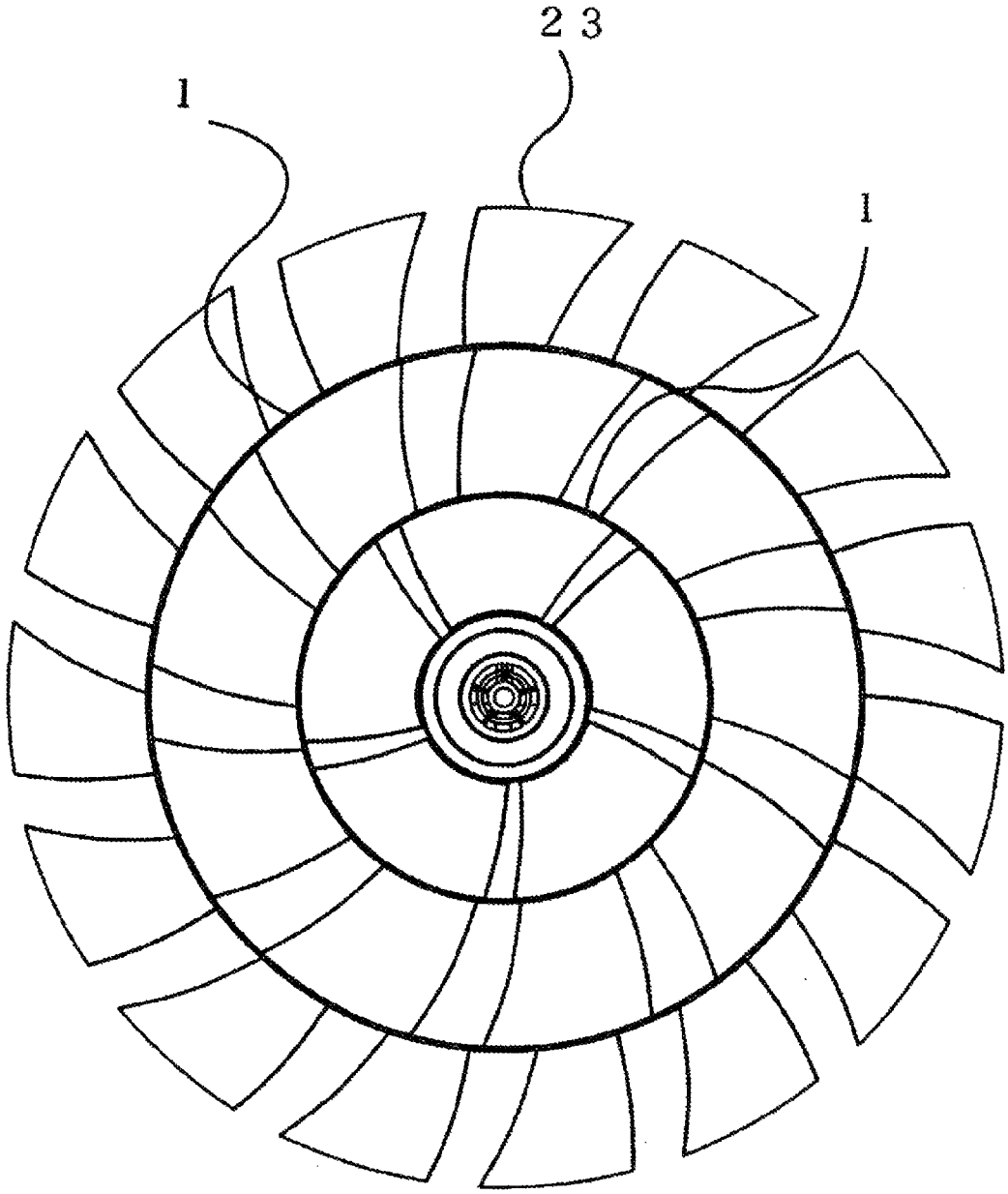
FIG. 11 is an explanatory view showing an axial flow fan equipped with a plurality of intermediate rings according to the present invention.

FIG. 11 is an explanatory view showing an axial flow fan equipped with a plurality of intermediate rings according to the present invention.

In the above-mentioned configuration, an axial flow fan 23 equipped with a plurality of intermediate rings 1 can be used instead of the axial flow fan equipped with the single intermediate ring 1 depending on the desired air blowing range, the spread direction of wind and the usage.

Embodiment 3

In the above-mentioned configuration, the difference between the velocity of the wind generated from the inner blade group of the intermediate ring 1 and the velocity of the wind generated from the outer blade group thereof becomes large when the axial flow fan is rotated, whereby an effect of changing the air blowing range of the fan is obtained, for example. For this reason, the blades 2 of the inner blade group of the intermediate ring 1 can be formed into, for example, a shaft having no air blowing function and used to simply connect the intermediate ring to the rotation shaft section, instead of a blade shape, depending on the desired air blowing range, the spread direction of wind and the usage.

Embodiment 4

In the above-mentioned configuration, the difference between the velocity of the wind generated from the inner blade group of the intermediate ring 1 and the velocity of the wind generated from the outer blade group thereof becomes large when the axial flow fan is rotated, whereby an effect of changing the air blowing range of the fan is obtained, for example. For this reason, the blades 2 of the inner blade group of the intermediate ring 1 can be formed into a blade shape for generating wind in a direction opposite to that of the wind generated by the blades 3 of the outer blade group of the intermediate ring 1 when the fan is rotated as a single axial flow fan, depending on the desired air blowing range, the spread direction of wind and the usage.

Embodiment 5

In the above-mentioned configuration, the diameter of the intermediate ring 1 can be set to a different size so as to be made larger or smaller between the diameter of the rotation shaft section and the outer circumference of the axial flow fan depending on the desired air blowing range, the spread direction of wind and the usage.

Figure 13:
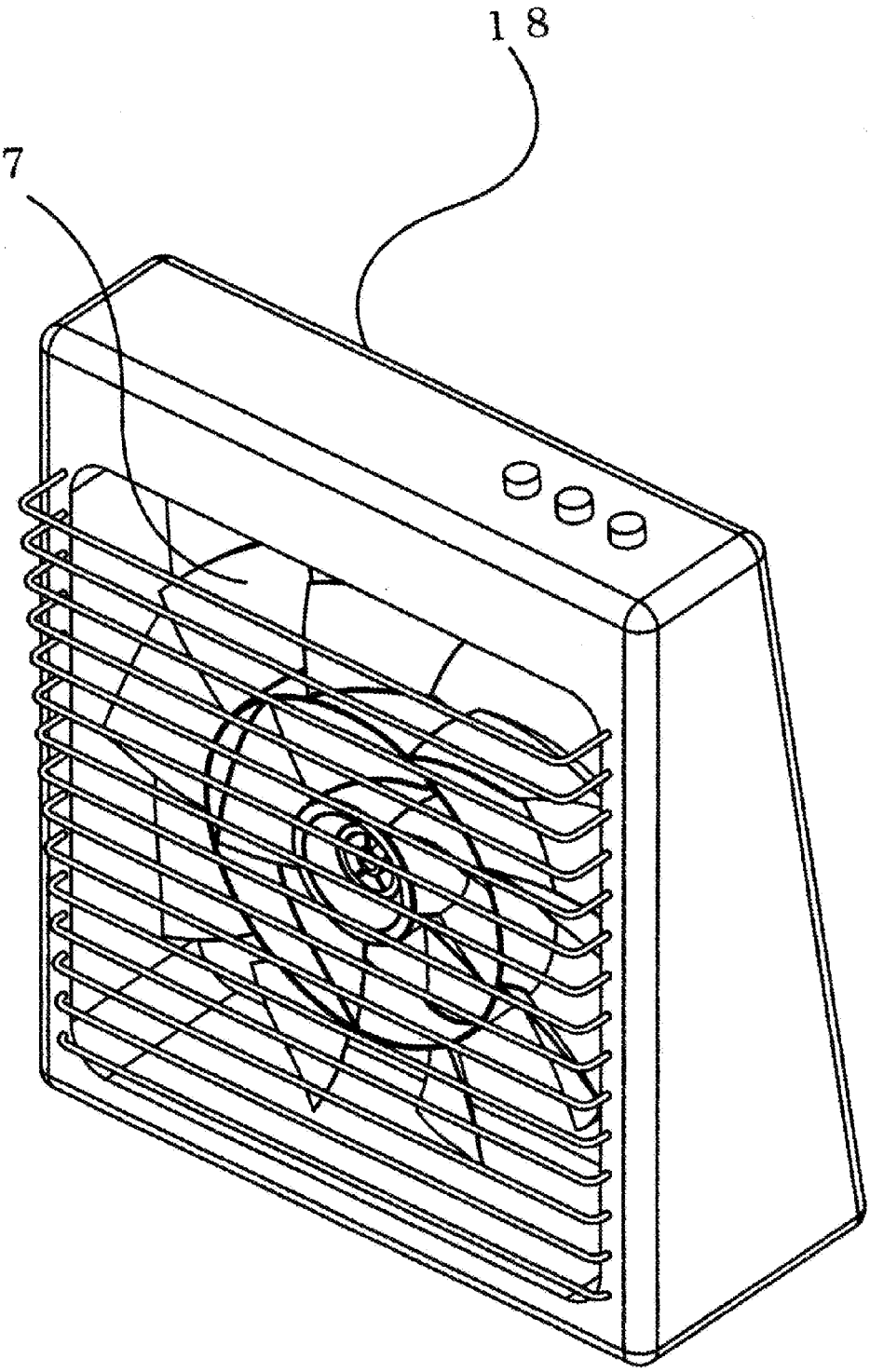
FIG. 13 is an explanatory view showing a heater incorporating the axial flow fan according to the present invention.

FIG. 13 is an explanatory view showing a heater incorporating the axial flow fan according to the present invention.

In the above-mentioned configuration, the axial flow fan according to the present invention can be used for not only a fan-type blower but also, for example, a blower portion of the heater 18 shown in FIG. 13, and can also be used for the air blowing sections of appliances requiring a function of blowing air in a wide range.

COMPARISON EXAMPLE 1

In the fan assembly 11 shown in FIG. 1 in Japanese Patent Application Laid-Open Publication No. Hei 10-141285, its rotation shaft section was positioned horizontally, the height of the rotation shaft section was set at 60 cm from the ground, and the rotation shaft section was rotated at 800 rpm. In order that the measurement results correspond to those shown in Table 3 described above, the wind velocity was measured at each point under measurement conditions similar to those of the measurement shown in Table 3. The results of the measurement are shown in Table 5. The value of the wind velocity is the average value of the wind velocity values measured continuously for two minute at each position.

TABLE 5

Unit: m/s

| | 75 cm leftward | 50 cm leftward | 25 cm leftward | Front | 25 cm rightward | 50 cm rightward | 75 cm rightward | |
|---|---|---|---|---|---|---|---|---|
| 0 | — | — | — | — | — | — | — | 0 |
| 25 cm | 0 | 0 | 0 | 3.05 | 0 | 0 | 0 | 0 |
| 50 cm | 0 | 0 | 0 | 2.84 | 0 | 0 | 0 | 25 cm |
| 75 cm | 0 | 0 | 0.32 | 2.61 | 0.3 | 0 | 0 | 50 cm |
| 100 cm | 0 | 0 | 0.41 | 2.50 | 0.42 | 0 | 0 | 75 cm |
| 125 cm | 0 | 0 | 0.49 | 2.32 | 0.5 | 0 | 0 | 100 cm |
| 150 cm | 0 | 0 | 0.71 | 2.09 | 0.68 | 0 | 0 | 125 cm |
| 175 cm | 0 | 0 | 0.84 | 1.93 | 0.82 | 0 | 0 | 150 cm |
| 200 cm | 0 | 0 | 0.75 | 1.75 | 0.71 | 0 | 0 | 175 cm |
| 225 cm | 0 | 0 | 0.61 | 1.55 | 0.58 | 0 | 0 | 200 cm |
| 250 cm | 0 | 0 | 0.55 | 1.48 | 0.51 | 0 | 0 | 225 cm |
| 275 cm | 0 | 0 | 0.45 | 1.32 | 0.49 | 0 | 0 | 250 cm |
| 300 cm | 0 | 0 | 0.39 | 1.21 | 0.43 | 0.04 | 0 | 275 cm |

In the fan assembly 11 shown in FIG. 1 in Japanese Patent Application Laid-Open Publication No. Hei 10-141285, the gap between the inner blades thereof is large, air is sucked from the gap between the inner blades by the fast and strong wind generated by the outer blade group thereof, and this air joins the wind generated by the inner blades, whereby the velocity of the obtained wind is increased. Hence, the difference between the velocity of the wind generated by the region of the inner blades and the velocity of the wind generated by the region of the outer blades does not become large, and the diameter of the wind is approximately 50 cm at a point 3 m away from the fan assembly; the wind does not spread widely.

INDUSTRIAL APPLICABILITY

Figure 12:
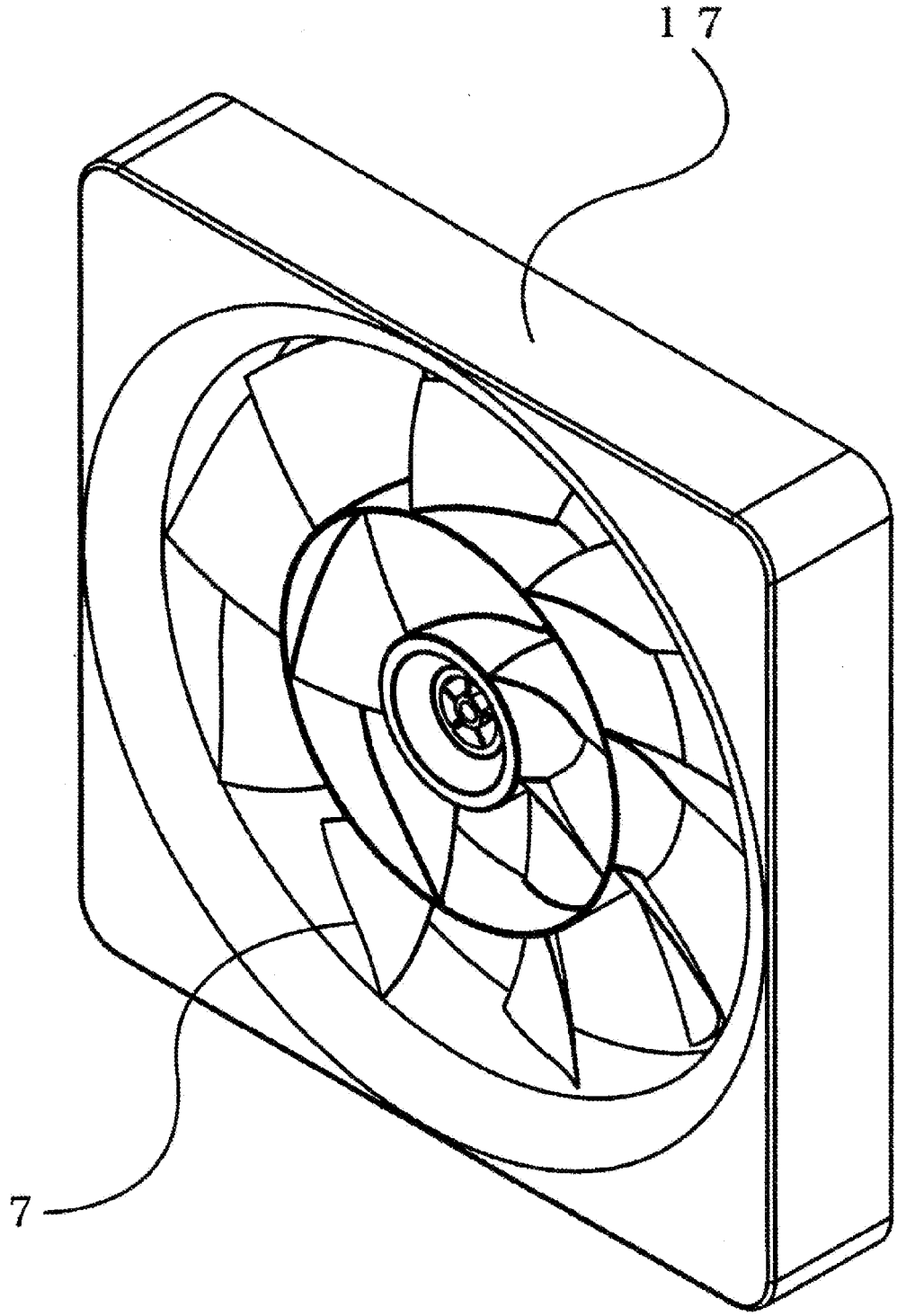
FIG. 12 is an explanatory view showing the axial flow fan according to the present invention mounted in a ventilator 17.

FIG. 12 is an explanatory view showing the axial flow fan according to the present invention mounted in a ventilator, and FIG. 13 is an explanatory view showing a heater incorporating the axial flow fan according to the present invention.

The use of the axial flow fan according to the present invention is not limited to fans and blowers. It is a matter of course that the axial flow fan can be used for all kinds of appliances requiring a blower inside, such as the ventilator 17 shown in FIG. 12 and the heater 18 shown in FIG. 13.

Furthermore, it is a matter of course that the axial flow fan according to the present invention can be used for all kinds of appliances required to be cooled, such as a computer, by decreasing the outside diameter of the fan and by incorporating the fan inside the computer.

Moreover, it is a matter of course that the axial flow fan according to the present invention can be used for all kinds of appliances and facilities for generating air flow, such as the air-conditioning and air-blowing sections of building facilities, by increasing the outside diameter of the fan.

Still further, it is a matter of course that in the axial flow fan according to the present invention, a substance, the movement of which generates flow, is not limited to air, but all kinds of fluid, such as gas and liquid, can be used as the substance, and that the axial flow fan can be used for all kinds of appliances for generating fluid flow, such as a screw rotated in water.

| EXPLANATIONS OF LETTERS AND NUMERALS | |
|---|---|
| 1 | an intermediate ring |
| 2 | the inner blades of the intermediate ring |
| 3 | the outer blades of the intermediate ring |
| 4 | the rotation shaft section of an axial flow fan |

-continued

| EXPLANATIONS OF LETTERS AND NUMERALS | |
|---|---|
| 5 | a motor |
| 6 | the rotation shaft of the motor |
| 7 | an axial flow fan according to the present invention |
| 8 | a motor supporting apparatus |
| 9 | a fan-type blower equipped with the axial flow fan according to the present invention |
| 10 | a general axial flow fan formed of conventional five blades |
| 11 | a wind velocity measurement point |
| 12 | a wind velocity measurement point |
| 13 | a fan-type blower equipped with the general axial flow fan formed of the conventional five blades |
| 14 | a wind velocity measurement point |
| 15 | a wind velocity measurement point |
| 16 | a wind velocity measurement point |
| 17 | a ventilator-type blower equipped with the axial flow fan according to the present invention |
| 18 | a heater equipped incorporating the axial flow fan according to the present invention in the air blowing function section thereof |
| 19 | wind spreading when the axial flow fan formed of the conventional five blades is rotated |
| 20 | wind spreading when the axial flow fan according to the present invention is rotated |
| 21 | an axial flow fan equipped with ten blades, the shape of which is the same as that of the conventional five blades |
| 22 | a blade overlapping portion as viewed from the front |
| 23 | an axial flow fan according to the present invention equipped with a plurality of intermediate rings |
| 24 | a space around the rotation shaft section at a position very close to the front of the axial flow fan according to the present invention |

-continued

| EXPLANATIONS OF LETTERS AND NUMERALS | |
|---|---|
| 25 | a space around the outer circumference at a position very close to the front of the axial flow fan according to the present invention |
| 30 | the direction of the wind at a position located a short distance from the axial flow fan according to the present invention when the fan is rotated |
| 31 | a position where the wind is collected when the axial flow fan according to the present invention is rotated |

What is claimed is:

1. An axial flow fan comprising:

a rotation shaft section to be mounted on the rotation shaft of rotation drive means, an inner blade group provided outside the rotation shaft section so as to be coaxial therewith, and an outer blade group provided outside the inner blade group so as to be coaxial therewith, wherein the inner blade group is formed of a plurality of inner blades provided radially around the rotation shaft section, the outer blade group is formed of a plurality of outer blades provided radially around the rotation shaft section, and the velocity $V_1$ of the wind generated by the inner blade group and the velocity $V_2$ of the wind generated by the outer blade group have a relationship of $1.5V_1<V_2$, wherein the inner blade and the outer blade have an attack angle in the rotation direction, and when the attack angle of the inner blade is $\alpha_1$ and the attack angle of the outer blade is $\alpha_2$, the attack angle $\alpha_1$ and the attack angle $\alpha_2$ have a relationship of $\alpha_1<\alpha_2$.

2. The axial flow fan according to claim 1, wherein when the total area of the inner blades is $S_1$ and the total area of the outer blades is $S_2$, the area $S_1$ and $S_2$ have a relationship of $S_1<S_2$.

3. The axial flow fan according to claim 2, wherein the outer blade group is provided outside the inner blade group via an intermediate ring.

4. The axial flow fan according to claim 3, wherein the total area $S_g$ of the gaps among the adjacent inner blades of the inner blade group as viewed from the front of the axial flow fan and the total area $S_1$ of the inner blades have a relationship of $S_g<0.12S_1$.

5. The axial flow fan according to claim 4, wherein the front fringe of the inner blade in the rotation direction and the front fringe of the outer blade in the rotation direction are not on a continuous line as viewed from the front of the fan, and the rear fringe of the inner blade in the rotation direction and the rear fringe of the outer blade in the rotation direction are not on a continuous line as viewed from the front of the fan.

* * * * *